US007997846B2

(12) United States Patent
Brunson

(10) Patent No.: US 7,997,846 B2
(45) Date of Patent: Aug. 16, 2011

(54) DRYWALL PANEL LIFTER

(76) Inventor: Jack Brunson, Bronx, NY (US)

( * ) Notice: Subject to any disclaimer, the term of this patent is extended or adjusted under 35 U.S.C. 154(b) by 366 days.

(21) Appl. No.: 12/260,664

(22) Filed: Oct. 29, 2008

(65) Prior Publication Data

US 2010/0101180 A1 Apr. 29, 2010

(51) Int. Cl.

| | |
|---|---|
| ***A47F 5/00*** | (2006.01) |
| ***B62B 3/04*** | (2006.01) |
| ***B62B 3/10*** | (2006.01) |
| ***B62B 3/12*** | (2006.01) |
| ***B66F 3/08*** | (2006.01) |
| ***B66B 1/00*** | (2006.01) |
| ***B65G 63/00*** | (2006.01) |

(52) U.S. Cl. ..... 414/11; 187/244; 254/103

(58) Field of Classification Search ..... 187/240, 187/244; 254/100, 103, 7 R, 98; 414/10–12, 414/450, 626

See application file for complete search history.

(56) References Cited

U.S. PATENT DOCUMENTS

| | | | | | |
|---|---|---|---|---|---|
| 639,328 | A | * | 12/1899 | Wilson | 254/7 R |
| 1,263,303 | A | * | 4/1918 | Wolf | 187/244 |
| 1,580,348 | A | * | 4/1926 | Thatcher | 254/103 |
| 3,784,160 | A | * | 1/1974 | Phillips | 254/425 |
| 4,842,473 | A | * | 6/1989 | Zbornik | 414/626 |

* cited by examiner

*Primary Examiner* — Gregory W Adams

(74) *Attorney, Agent, or Firm* — Marguerite Del Valle

(57) ABSTRACT

A drywall panel lifter having two stanchions into which jacks are vertically set, wherein each jack has an extending portion capable of rising past the tops of the first and second stanchion respectively; a set of bars hinged to the jacks; a cross-piece assembly connecting the bars, having a crank is operatively connected to the screw gear that operates the jacks; and panel holding grippers mounted on the extending portion of the jacks.

3 Claims, 4 Drawing Sheets

DRYWALL PANEL LIFTER

The invention is directed to a drywall panel lifter consisting of double stanchions with stabilizing bar and extension arms capable of grasping a drywall panel. A crank on the stabilizing bar operates screw gears within the extension arms to lift and position a panel.

BACKGROUND OF THE INVENTION

Numerous drywall panel lifters are known in the art. Among them is U.S. Pat. No. 7,101,136 to Ray et al, for Drywall Panel Carrier. This reference discloses a panel lifter having a pair of panel-supporting legs of square tubing attachable to side rails of a lift platform. Each leg is connected to the rails by an upper bracket at the top of the leg and a lower bracket at a middle location. A panel-receiving U-shaped channel is located on the opposite side of the legs, away from the rails. The lower bracket has a standoff member projecting the bottom of the leg outward at an angle. A roller at the base of the channel provides low-friction rolling contact with an inserted panel, and a groove in this roller serves to guide the panel. Rollers at the tops of the legs and elsewhere are placed to keep panels from being damaged by contact with the legs.

U.S. Pat. No. 6,773,218 to Mingoes, for Adjustable Ceiling Panel Lifting Apparatus discloses a device having lift support assemblies each including a support base member and a pair of support rail members being spaced apart and extending upwardly from the support base members. The lift support assemblies are mounted on wheel assemblies. Lift actuating members are engaged to and raise and lower the lift members. Elongate support members interconnect the lift support assemblies.

U.S. Pat. No. 6,244,810 to Reyes, for Drywall Handyman discloses a device for elevating drywall onto a ceiling at various angles. The device includes a base member, a telescoping member secured to said base member projecting upwardly, a disc pivotally attached to the telescoping member opposite the base member, a support member secured to the pivoting assembly allowing coupling to the drywall, a crank pivotally secured within the lower portion of the telescoping-member, a pulley secured to the upper portion of the telescoping member, and a cable engaging the crank, projecting through the pulley and engaging and extending the telescoping member.

U.S. Pat. No. 4,375,934 to Elliott, for Lifting and Positioning Apparatus for Construction Panels discloses an apparatus including a base, a fixed strut supported vertically from the base, a movable strut supported from the fixed strut, a guide and latch arrangement for retaining the struts in generally parallel relationship, a handle on the movable strut for elevating same in relation to the fixed strut and the base, and a panel engaging rail supported on the movable strut. The panel engaging rail may be supported at the top of the movable strut, in which case, two of the standards are used to elevate and position a panel against the underside of a ceiling framework.

Commercially available drywall panel lifters include the Buffalo Tools DWHOIST Drywall Lift Hoist from www.constructioncomplete.com and the Telpro Drywall PANELLIFT from www.all-wall.com. Each consists of a stanchion mounted on a tripod, each leg of which is fitted with a 5-inch caster. The drywall panel is held by a U-shaped bracket and supported by an H-shaped beam structure. Once placed on the device, a fast action, single-stage winch equipped with a cam lock brake lifts the supporting structure to position the panel where desired.

BRIEF SUMMARY OF THE INVENTION

The present invention consists of a drywall panel lifter consisting of a double stanchion device with stabilizing bar and extension arms capable of grasping a drywall panel. A crank on the stabilizing bar operates screw gears within the extension arms to lift a panel. Casters on the stanchions allow lateral positioning.

DETAILED DESCRIPTION OF THE INVENTION

Figure 1:
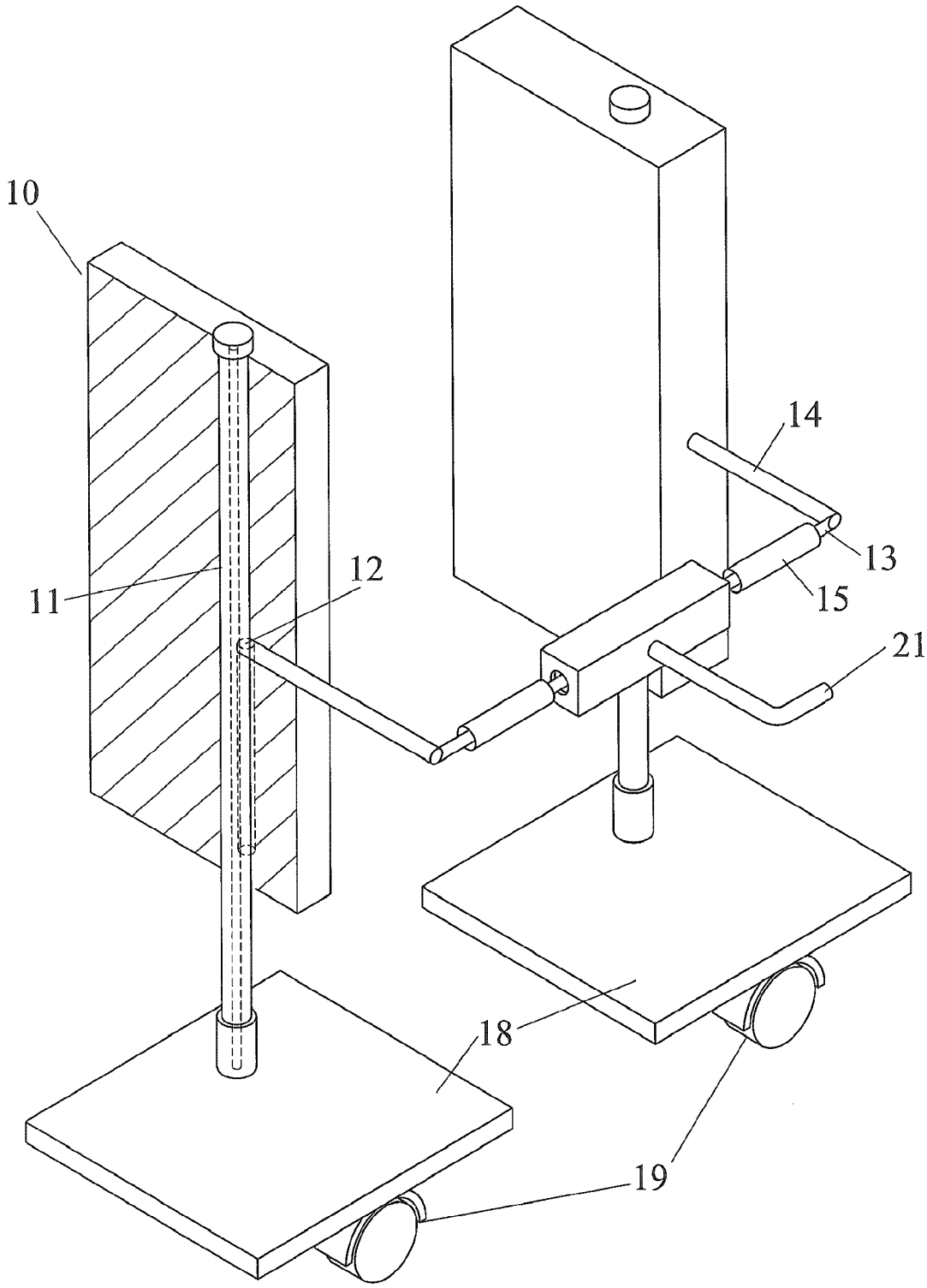
FIG. 1 is top, front perspective view of the device of the present invention, with a cut-away view of one of the stanchions.
Figure 2:
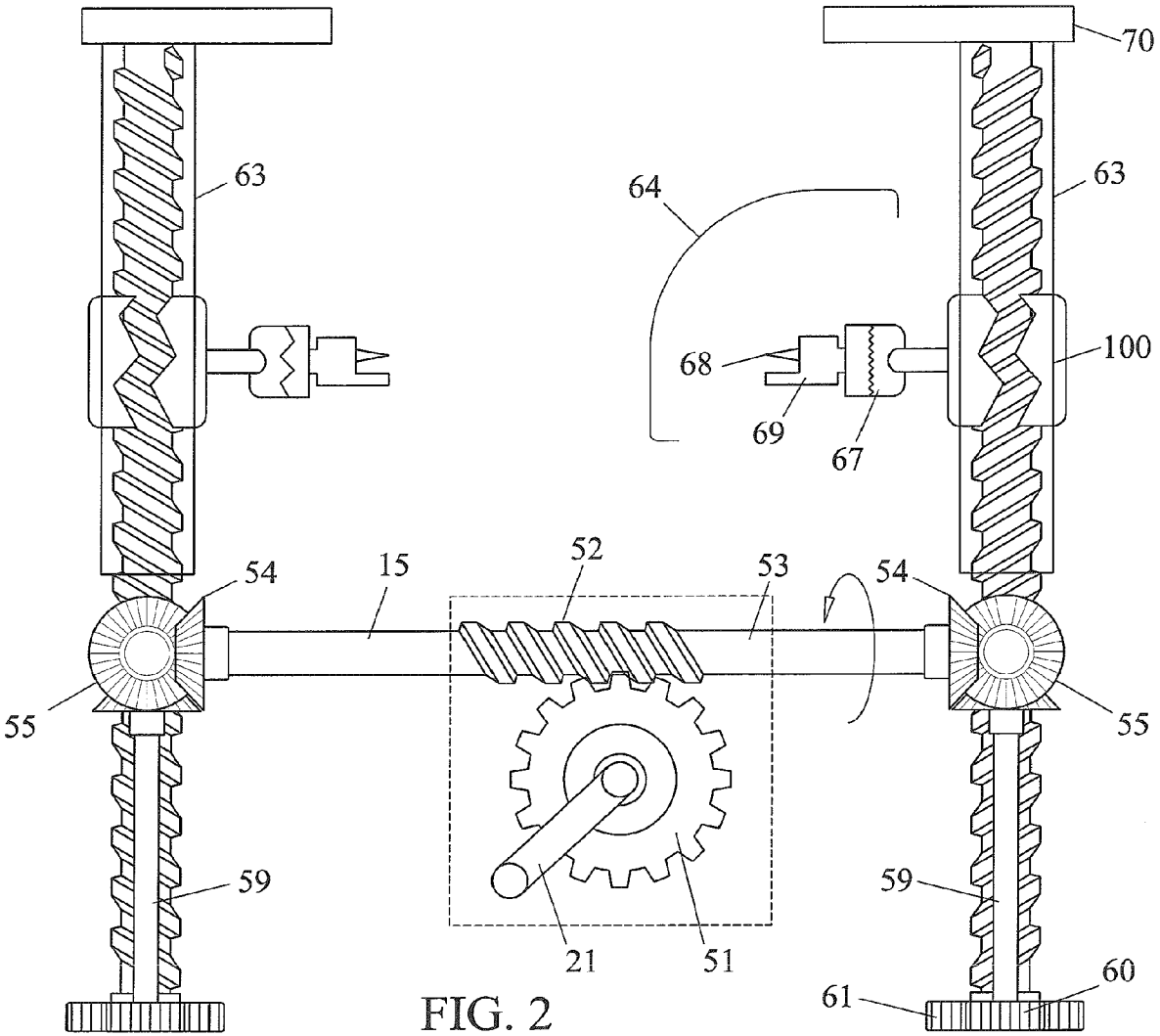
FIG. 2 is a cut-away front view of the device shown in FIG. 1 illustrating the screw gear assembly and the second set of bevel gears.

As shown in FIG. 1, the inventive device consists of two stanchions 10, each of which house vertical tubing 11. At a point along the length of each tubing 11 is a hinge 12, to which is connected a stabilizing assembly 13. The stabilizing assembly 13 consists of arms 14 and a cross-piece assembly 15. Tubing 11 and assembly 13 cover an interior structure, preferred embodiments of which are shown in FIGS. 2-5.

At the mid-section of assembly 15 is a crank 21. Crank 21 is operatively connected to sprocket 51 which engages worm gear 52, rotating shaft 53 which has bevel gears 54 at its ends. Bevel gears 54 engage bevel gears 55 which rotate shafts 56. At the end of each shaft 56 is bevel gear 57 which engages and rotates bevel gear 58 which sits on the top end of vertical shaft 59. At the bottom end of shaft 59 is spur gear 60 which engages and rotates spur gear 61 from which extends threaded rod 62.

Figure 3:
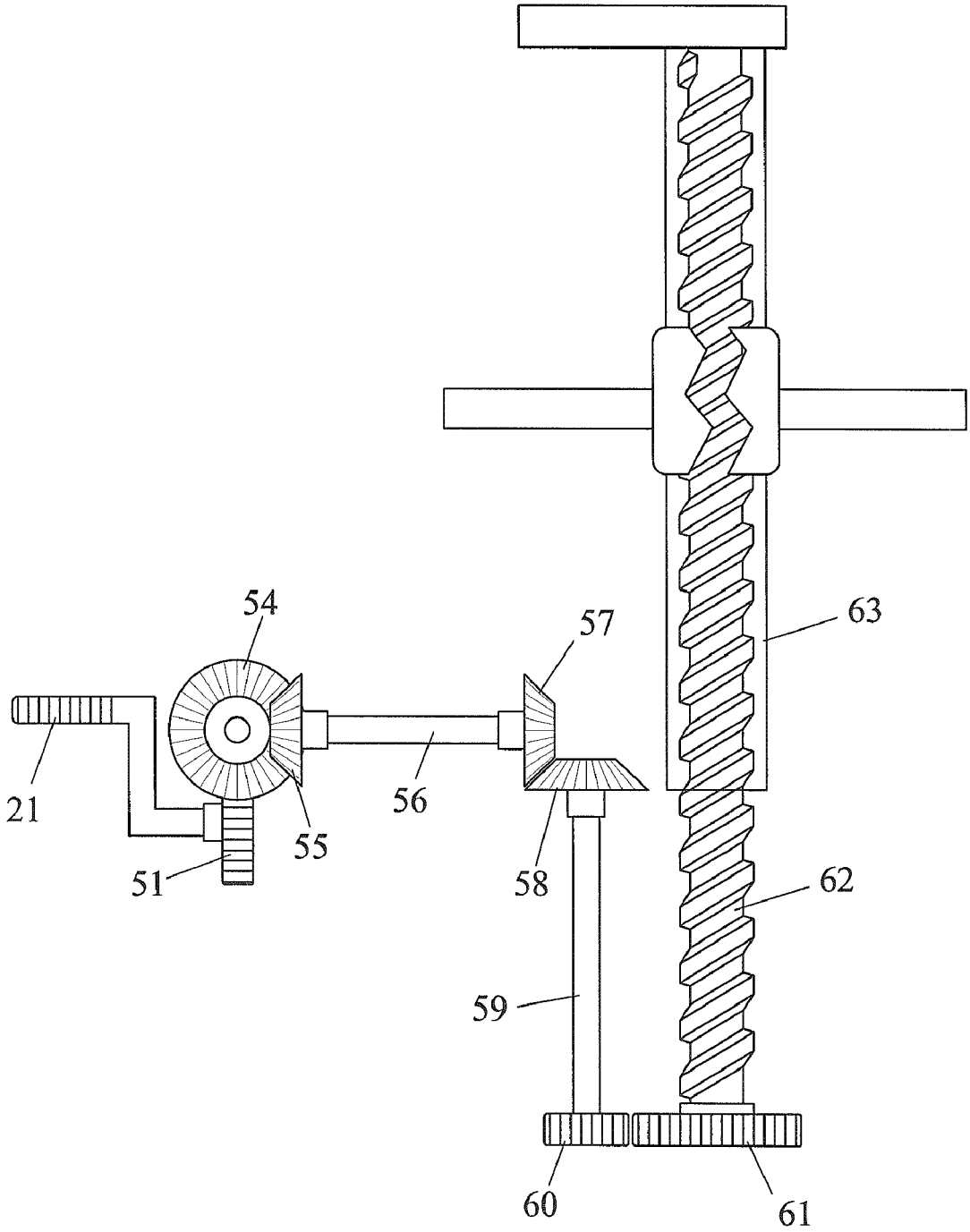
FIG. 3 is a cut-away side view of the device shown in FIG. 1 showing the first, second and third bevel screw sets and the first and second spur set.
Figure 4:
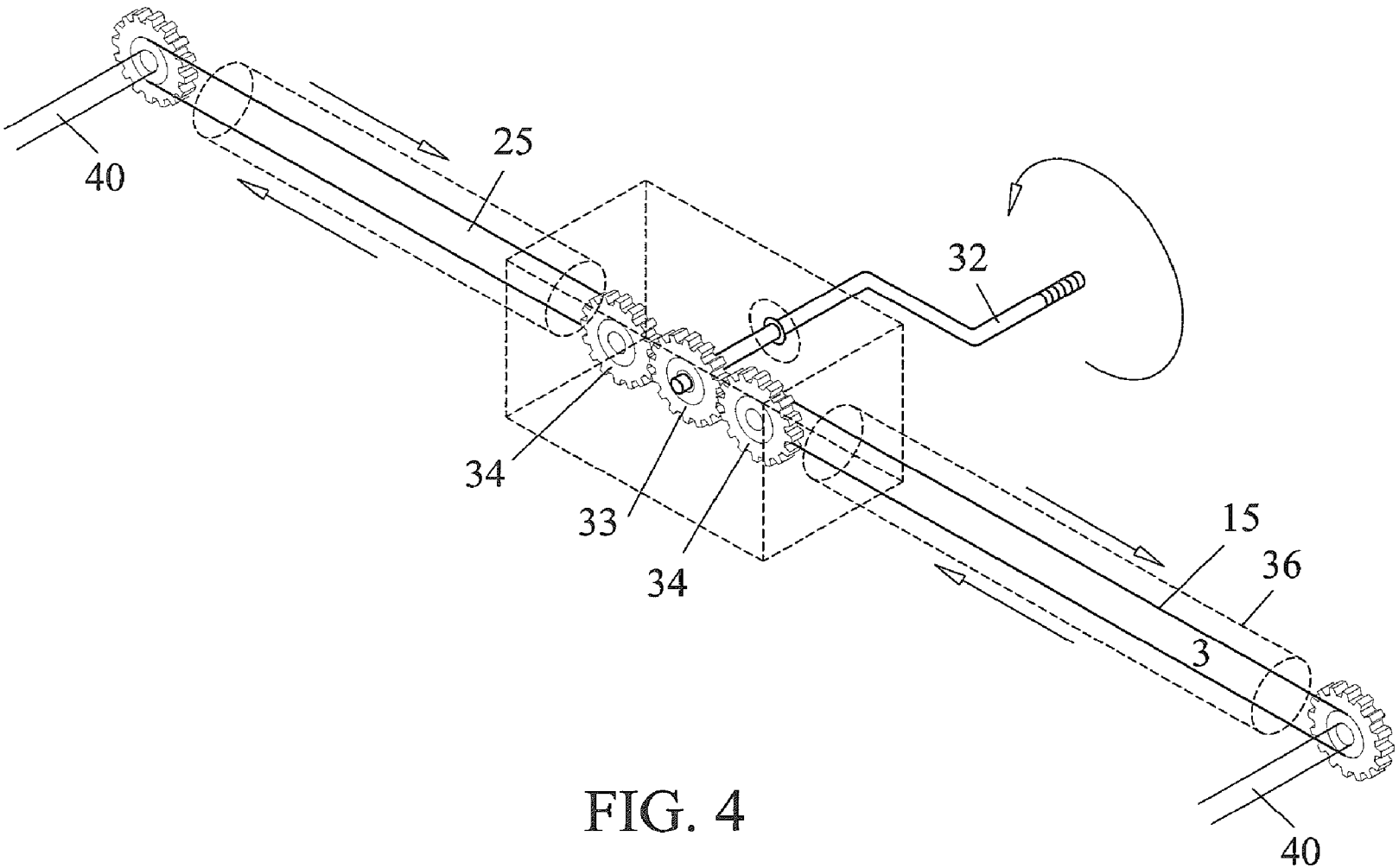
FIG. 4 is an alternative embodiment of the cross-piece assembly.

A second embodiment of the cross-piece assembly 15 is shown in FIG. 4 where crank 32 consists of a handle 22 which turns a central sprocket 33 which is operatively connected on either side to side sprockets 34. Chain 35 runs in a loop, over side sprocket 34 through tube 36 and over end sprocket 37. Shaft 40 extends from the face of end sprocket 27 through arm 14; at the other end of shaft 30 is bevel gear 57, as shown in FIG. 3.

The device performs as two synchronized jacks. The user turns the crank which causes threaded rods 62 to rotate such as to cause internally threaded telescoping tubes 63 coaxially located inside tubes 11 to rise. Affixed to tubes 61 are drywall panel holders 64 shown in FIG. 3 consisting of brackets 67 having an extension 68 onto which is fitted a brace 69. The edge of a drywall panel (not shown) is fit into the space between extension 68 and brace 69. The tubes are made to rise until ceiling plate 70 makes contact with the ceiling. When that occurs, the drywall panel is in position for attachment. Positioning can be adjusted before the ceiling plate contacts the ceiling by moving the stanchions. This is facilitated if the stanchions are mounted, as shown in FIG. 5, on casters or the like.

The invention claimed is:

1. A drywall panel lifter comprising a. a first stanchion and a second stanchion, each having a base and a top;

b. a first jack vertically set into the first stanchion and a second jack vertically set into the second stanchion wherein each jack has a base end and an extending portion and wherein each extending portion is capable of rising past the tops of the first and second stanchion respectively;

c. a first bar hinged at a first end to the first jack and a second bar hinged at a first end to the second jack;

d. a cross-piece assembly connected to a second end of the first bar and a second end of the second bar having therein a crank and a screw gear wherein the crank is operatively connected to the screw gear that operates the first jack and the second jack;

e. a first gripper mounted on the extending portion of the first jack and a second gripper mounted at the extending portion of the second jack wherein said grippers are configured to hold a panel; and f. a first ceiling plate mounted on the extending portion of the first jack and a second ceiling plate mounted on the extending portion of the second jack wherein the extending portions can be raised such that the ceiling plates contact the ceiling.

2. A drywall panel lifter according to claim 1 wherein the bases of the first and second stanchions are mounted on lockable wheels.

3. A drywall panel lifer comprising a. a first stanchion and a second stanchion, each having a base and a top;

b. a first jack vertically set into the first stanchion and a second jack vertically set into the second stanchion wherein each jack has a base end and an extending portion and wherein each extending portion is capable of moving upward past the tops of the first and second stanchion respectively;

c. a first bar hinged at a first end to the first jack and a second bar hinged at a first end to the second jack;

d. a cross-piece assembly connected to a second end of the first bar and a second end of the second bar having therein a crank and a screw gear wherein the crank is operatively connected to the screw gear such that the screw gear rotates when the crank is turned, turning a first set of shafts that cause a first set of bevel screws to rotate, that cause a second set shafts to turn which cause a second set of bevel gears to rotate, that cause a third set of shafts to turn which cause a third set of bevel gears to rotate, that cause a fourth set of shafts to turn that cause a first set of spur gears to rotate, causing a second set of spur gears to rotate, which rotates a set of threaded rods to which are threaded a set of internally threaded tubes that rise, wherein the extending portions of the jack are attached to the threaded tubes, thus causing the extending portions of the jacks to rise; and e. a first gripper mounted on the extending portion of the first stanchion and a second gripper mounted at the extending portion of the second stanchion wherein said grippers are configured to hold a panel.

* * * * *